US008033409B2

(12) United States Patent
Lindemann

(10) Patent No.: US 8,033,409 B2
(45) Date of Patent: Oct. 11, 2011

(54) PACKAGED COMBINATION INCLUDING A FLUID CONTAINER HAVING WALLS DIMENSIONED TO RECEIVE A SOLID OBJECT, INCLUDING EDIBLE ITEMS

(76) Inventor: Donald C. Lindemann, San Antonio, TX (US)

( * ) Notice: Subject to any disclaimer, the term of this patent is extended or adjusted under 35 U.S.C. 154(b) by 273 days.

(21) Appl. No.: 11/974,290

(22) Filed: Oct. 12, 2007

(65) Prior Publication Data

US 2008/0035496 A1 Feb. 14, 2008

Related U.S. Application Data

(63) Continuation of application No. 11/246,971, filed on Oct. 7, 2005, now abandoned.

(60) Provisional application No. 60/617,197, filed on Oct. 8, 2004.

(51) Int. Cl.
*B65D 6/28* (2006.01)

(52) U.S. Cl. ..... 220/4.21; 215/6; 215/10; 220/23.4; 220/23.83

(58) Field of Classification Search ..... 206/217, 206/457; 215/6, 10, 228, 386, 387, 390, 215/395; 220/4.21, 4.24, 4.32, 4.33, 23.2, 220/23.4; 426/115, 120

See application file for complete search history.

(56) References Cited

U.S. PATENT DOCUMENTS

| | | | | | |
|---|---|---|---|---|---|
| 180,132 | A | | 7/1876 | Howard et al. | |
| 279,216 | A | | 6/1883 | Berlien | |
| 544,219 | A | | 8/1895 | Godet | |
| 730,337 | A | | 6/1903 | Bonnefont | |
| 1,289,218 | A | | 12/1918 | Maiden | |
| 1,686,354 | A | | 10/1928 | Wallace | |
| 1,993,978 | A | | 3/1935 | Plochman | |
| 2,825,085 | A | * | 3/1958 | Ingraham | 220/23.4 |
| 3,197,071 | A | | 7/1965 | Kuster | |
| 3,658,204 | A | | 4/1972 | Bottger | |
| 3,732,999 | A | | 5/1973 | Rounkles | |
| 4,126,239 | A | * | 11/1978 | Gehrig et al. | 215/6 |
| 4,592,478 | A | | 6/1986 | Laconis | |
| 4,889,261 | A | | 12/1989 | Conrad | |
| 5,050,757 | A | | 9/1991 | Hidding et al. | |
| 5,065,875 | A | * | 11/1991 | Balavich | 215/10 |
| 5,316,398 | A | * | 5/1994 | Chandaria et al. | 215/6 |
| 5,351,851 | A | | 10/1994 | Powell | |
| 5,356,040 | A | | 10/1994 | Reggiana | |
| D385,184 | S | | 10/1997 | Binter | |
| 5,735,422 | A | * | 4/1998 | Binter | 220/4.21 |
| 5,954,213 | A | * | 9/1999 | Gerhart et al. | 215/10 |
| 6,063,223 | A | | 5/2000 | Klauke et al. | |
| 6,672,480 | B1 | | 1/2004 | Miller | |
| 2004/0226904 | A1 | * | 11/2004 | Schroeder | 215/6 |

* cited by examiner

*Primary Examiner* — Luan K Bui
(74) *Attorney, Agent, or Firm* — Kammer Browning PLLC

(57) ABSTRACT

A packaged combination includes a fluid container having walls that are dimensioned to receive a solid object, for example, an edible item. The fluid container may be a single portion with areas cut out to receive an edible item or the fluid container may have two separate portions capable of holding the same or different fluids, which two separate portions each have walls cut out that, when acting together, may at least partially enclose an edible object.

4 Claims, 17 Drawing Sheets

PACKAGED COMBINATION INCLUDING A FLUID CONTAINER HAVING WALLS DIMENSIONED TO RECEIVE A SOLID OBJECT, INCLUDING EDIBLE ITEMS

This is a continuation patent application that claims priority from and incorporates herein by reference, U.S. patent application Ser. No. 11/246,971, filed Oct. 7, 2005, now abandoned and U.S. Provisional Patent Application Ser. No. 60/617,197, filed Oct. 8, 2004.

FIELD OF THE INVENTION

Packaged combinations, more specifically, a packaged combination comprising of fluid container having walls at least partially dimensioned to receive an edible item, the edible item combined with the fluid container to provide a packaged combination for sale to consumer.

BACKGROUND OF THE INVENTION

Some items may sell better as a combination —for example, popcorn and soda, nuts and beer or toy and beverage for children. It is well known that attractive packaging helps sell goods to consumers. Therefore, items are sometimes packaged together so as to boost sales.

Applicant provides a novel packaged combination comprising a drink and an edible, typically solid, food item, such as a candy or a snack. More specifically, Applicant provides a container for containing a fluid, such as soda, fruit drink, mineral water, beer or spirits therein, the fluid container having walls, at least partially dimensioned, to receive an edible item, such as a candy bar, energy bar, package of popcorn, candy bits, etc., therein and a means to engage the two so they may be sold as a package combination.

For example, a typical cylindrical plastic beverage container such as a 12-20 ounce soda container may have walls modified from the cylindrical shape, in a variety of ways, but so as to at least partially engage a packaged or unpackaged edible food item. The edible food item is packaged with the fluid container by some means for attaching the two physically together, such as: using the label of the container to physically hold the edible food item against the walls of the container; using a tie or a string, tape or glue to otherwise hold the edible item or items against the fluid container or providing a cap or a lid, in combination with a cutout volume of the walls of the fluid container so as to insert the food item or items into the enclosed interior volume of the fluid container and providing a cap or lid to seal the items therein.

The drawings set forth below provide several examples of some fluid containers with walls modified to receive food item or items and a means to engage the food item or items to the fluid container.

DETAILED DESCRIPTION OF THE PREFERRED EMBODIMENT

Figure 1A:
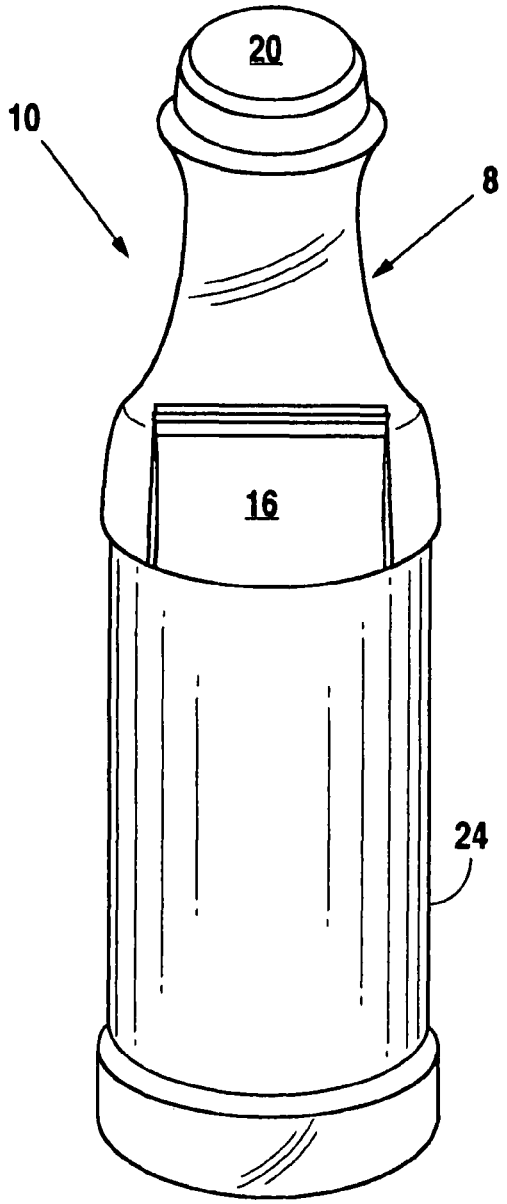
FIGS. 1A and 1B provide a front and side perspective view of a fluid container illustrating an edible food item engaged therewith, the food container having walls cutout to at least partially receive the edible food item.

Reference is made to the foregoing embodiments, and set forth below is a partial list of the elements thereof:

8 package combination including a container having cutout walls

10 fluid container of the package combination

12 walls defining a cutout area 14

16 edible item

20 container lid

22 cutout lid

24 item retainer member

Figure 1B:
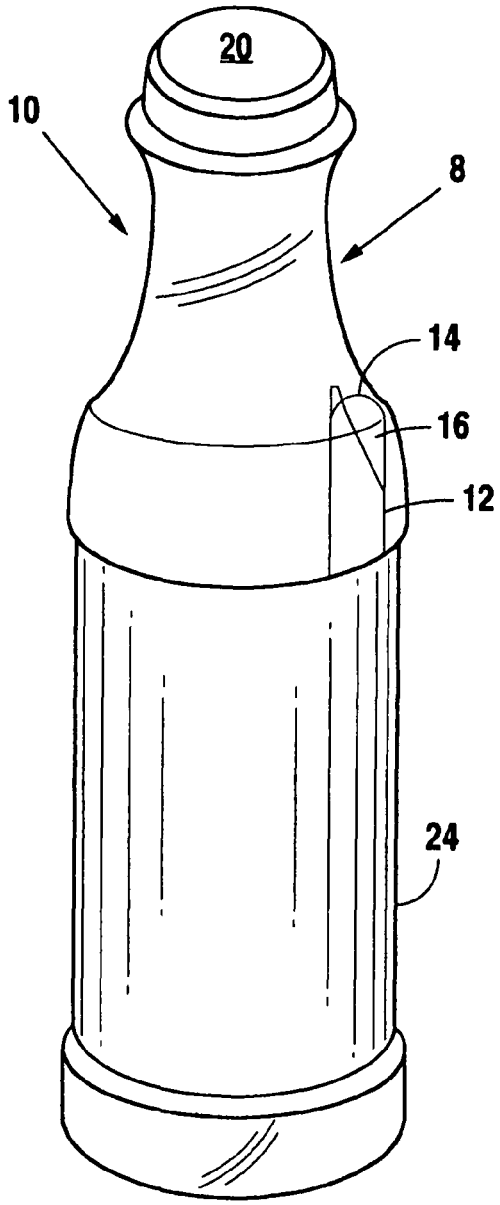

26, 28 container portions
30 container bottom wall
34 split drinking opening
36 boss or projection
38 channel, receiver for boss
40 tear off strip FIGS. 1A and 1B illustrate a fluid container (10) including an edible item (16) in walls (12) defining a cutout therein (walls shown in dotted lines in FIG. 1B). It is noted here that an item retainer member (24), here a label, is provided herewith. The examples illustrated here are pint sized milk bottles intended to hold a "Granola" bar. It is further noted that Applicant's package combination (8) includes a container lid (22) to contain the fluid, here milk, therein. Note that the walls (12) define a cutout in the cylindrical sidewalls of the container such that the depth of the cutout is the approximate thickness of the package food item such that the label can generally conform to the cylindrical shape of the sidewalls of the fluid container (10) when the edible item (16) is contained in cutout (14).

Figure 2A:
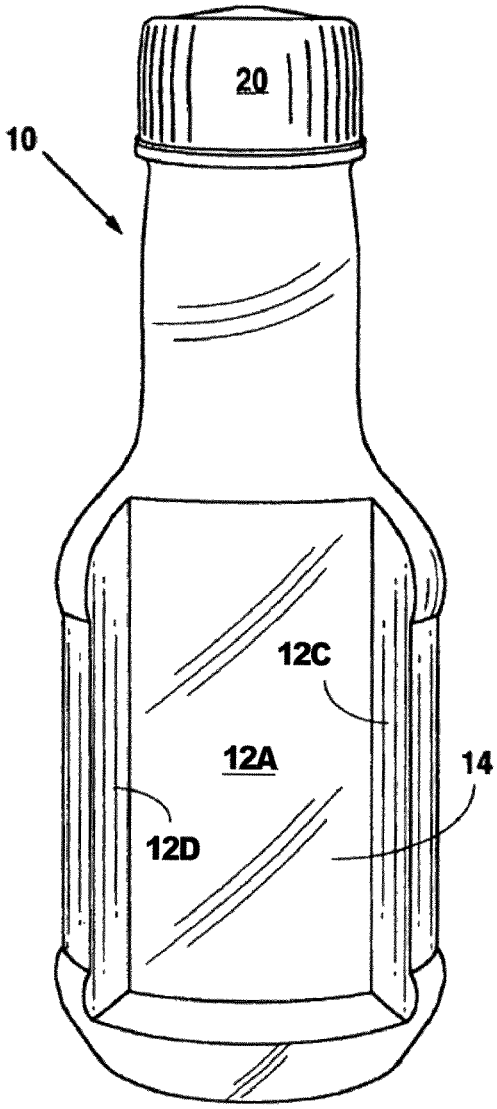
FIGS. 2A and 2B provide an additional view of a fluid container packaged with several food items, here the fluid container being a beer bottle packaged with a pair of cheese sticks and a pair of sausage sticks, the food item received within cutout walls of the fluid container dimensioned to receive the same.
Figure 2B:
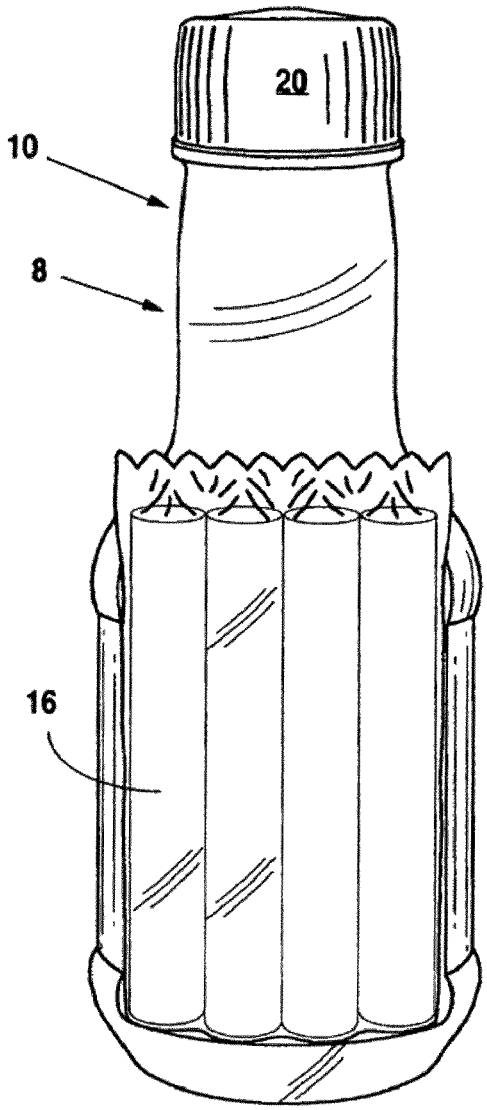

FIGS. 2A and 2B illustrate cutout (14), again dimensioned to receive edible item (16) (food sticks), here the package combination (8) being, for example beer or ale, packaged with a logical combination—food sticks of the type typically sold in a convenience store or a bar and eaten while the beer is consumed. The cutout (14) here may be dimensioned to be the approximate thickness of the food item and the approximate height, and includes a depression defined by a cutout base (12A), a cutout bottom wall (12B) and cutout sidewalls (12C/12D). Edible item (16) may be engaged with fluid container (10) by means of either a label (24), not shown in this rendering for clarity, glue or other suitable adhesive or retainer member.

Figure 3A:
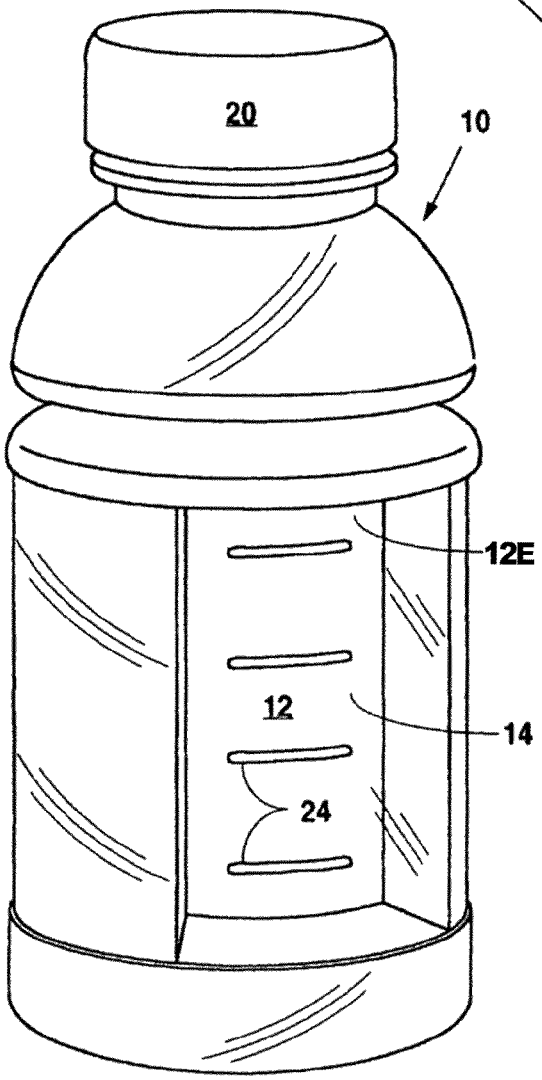
FIGS. 3A and 3B illustrate front perspective views of yet another version of Applicant's novel packaged combination.
Figure 3B:
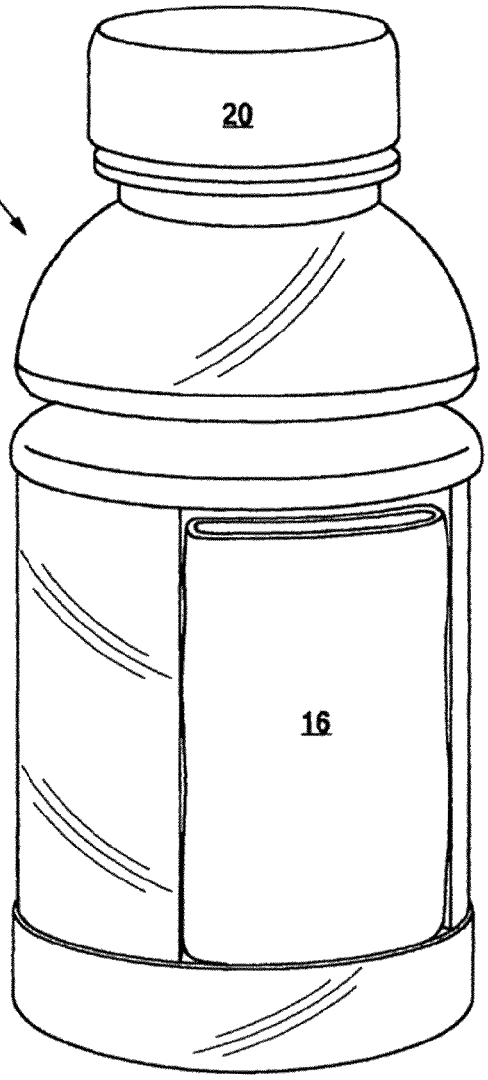

FIGS. 3A and 3B illustrate yet another novel package combination (8) where cutout (14) includes walls (12), the walls defining a cutout similar to that set forth in the embodiment in FIGS. 2A and 2B except having a cutout top wall (12E) and also illustrating that retainer member (24) may include the application of glue to walls (12) for engagement with edible item (16) along with an additional retainer member (24) such as a label (not shown for clarity). Here, fluid container (10) contains a fruit juice and edible item (16) contains a health snack, for example, a Fig Newton Bar. Fluid container (10) may be made of plastic and may include a container lid (20).

Figure 4A:
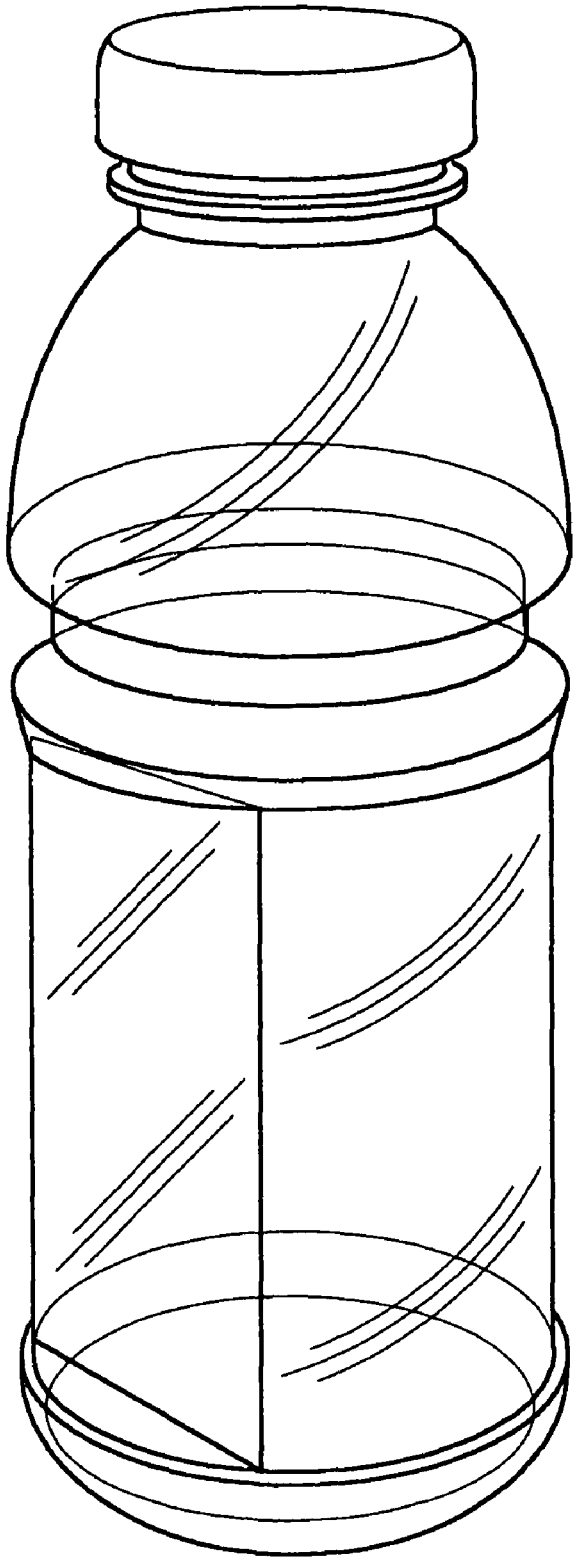
FIGS. 4A, 4B and 4C illustrate three perspective views, from the side, illustrating yet another form of Applicant's novel packaged combination, here an "Energy Drink" in a fluid container, combined with a "Sports Bar."
Figure 4B:
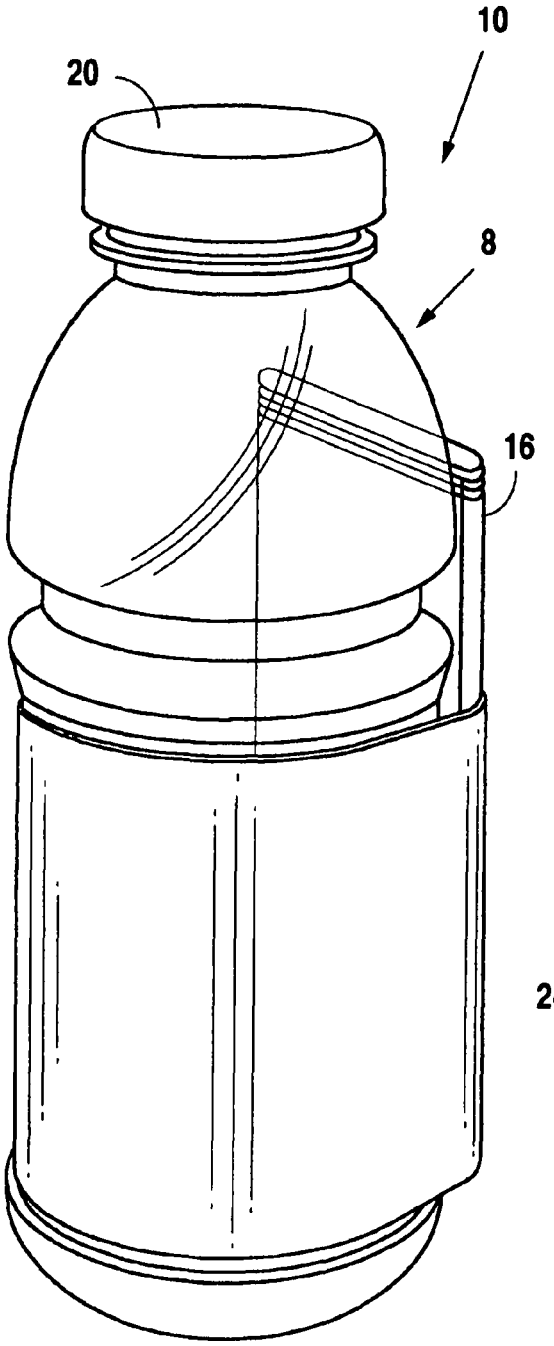
Figure 4C:
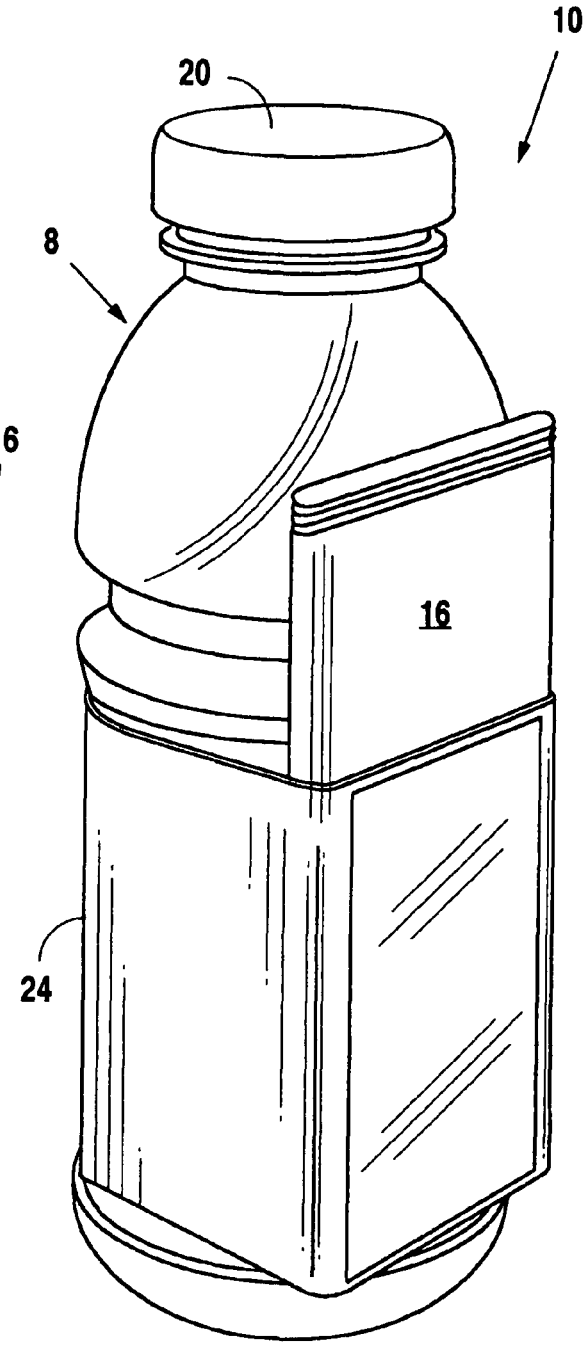

FIGS. 4A, 4B and 4C are computer animated drawings illustrating a fluid container (10) having walls (12) defining a cutout comprising merely a cutout base (12A) yet which base may receive an edible food item (16) and which base may define a cutout (14) with an approximate depth, at least at a maximum point, approximately the same thickness as food item (16). Here it is seen, as with the view set forth in FIGS. 4B and 4C, that retainer member (24) may include a label and there may be some protrusion of the food item outside the normally cylindrical sidewalls of the container yet, at least in part, the walls (12) define a cutout base (12A) in which part of the food item may lay against, to at least assist in conforming package food combination (8) to a generally cylindrical volume.

Figure 5A:
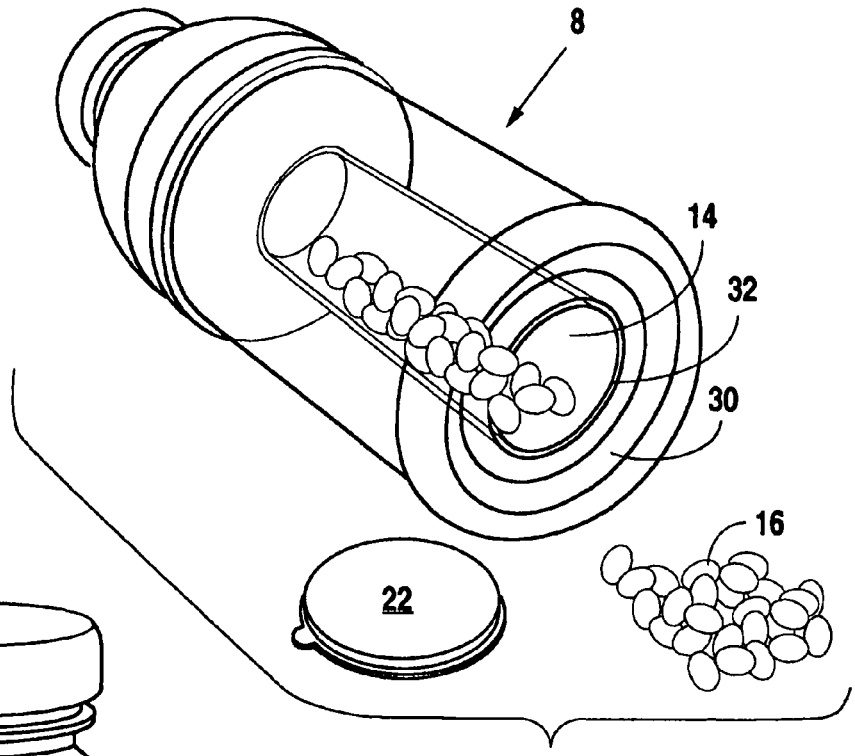
FIGS. 5A and 5B represent a side and bottom perspective view of yet another novel combination of Applicant's packaged combination.
Figure 5B:
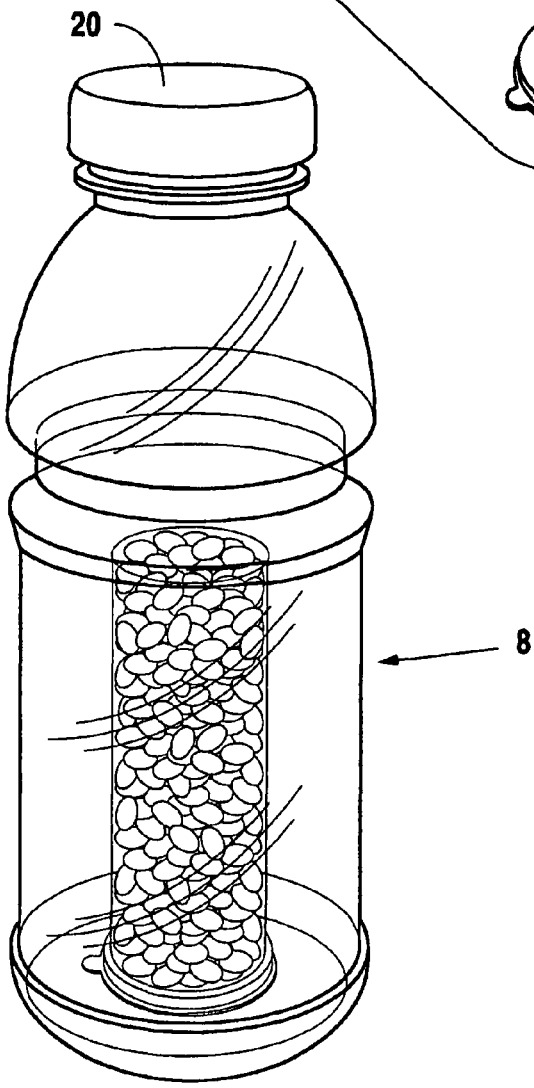

FIGS. 5A and 5B provide yet another alternate preferred embodiment of Applicant's novel package combination (8). The previous alternate preferred embodiments illustrated various cutouts (14) in the sidewalls of a typically cylindrical container. FIGS. 5A and 5B provide a cutout (14) which cutout extends into the interior volume of the container from container bottom wall (30), which is provided with a cutout lid (22) conforming to cutout opening (32). As in the foregoing and following embodiments, the container may be clear, opaque, non-opaque, but in a preferred embodiment, one would be able to see the edible item (16) that provide the contents of cutout (14), through the walls of fluid container (10). Note here that edible item need not be a single wrapped food item, but may be a multiplicity of items such as M&M's, fruit drops, etc. One novel application heretofore not mentioned is a small bottle of water with OTC unit doses of medicines, such as Tylenol, ibuprophen, aspirin, stomach aids, or any number of remedies that might be taken with water and conveniently purchased at a store or airport location.

Figure 6A:
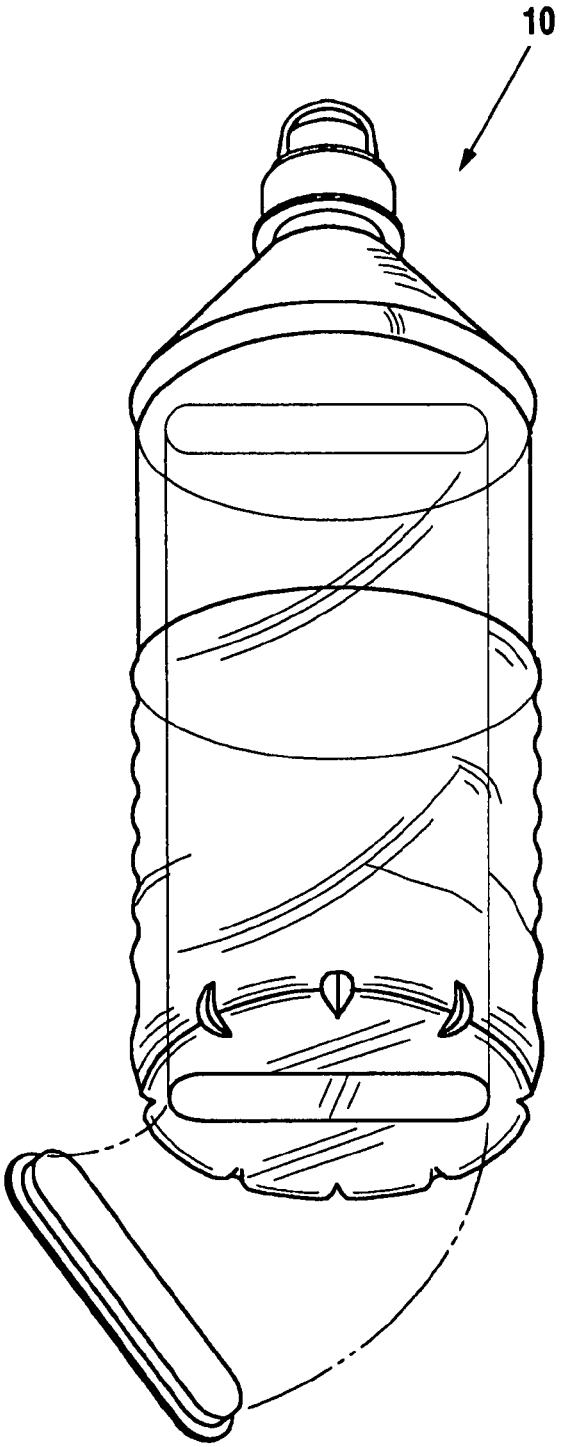
FIGS. 6A, 6B and 6C present yet another variation of Applicant's novel packaged combination, including a drink container with walls dimensioned to receive an edible item within an interior volume thereof.
Figure 6B:
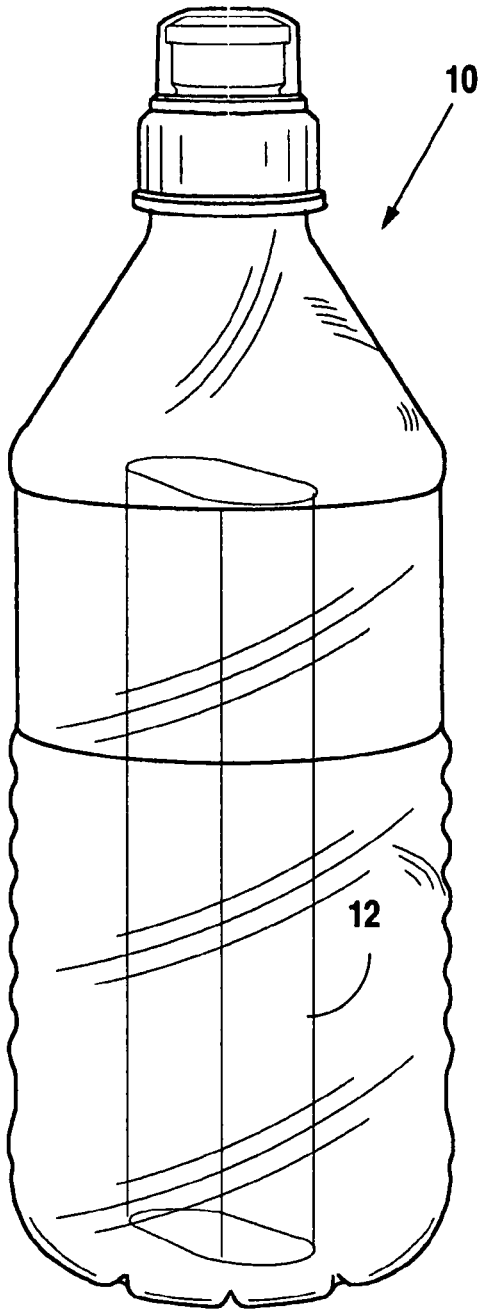
Figure 6C:
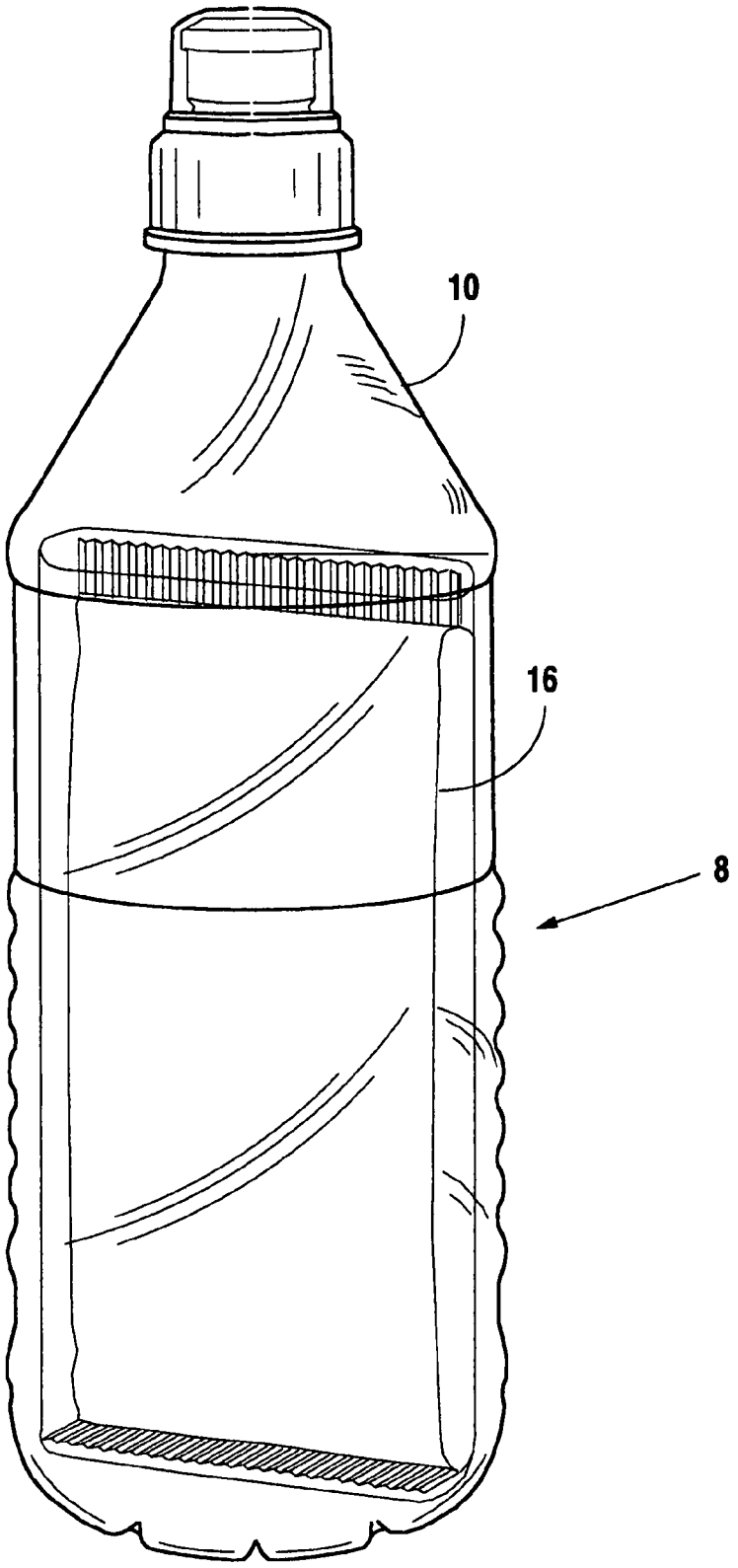

FIGS. 6A, 6B and 6C illustrate an embodiment similar to that set forth in FIGS. 5A and 5B—namely, wherein cutout (14) extends from container bottom wall (30) and is dimensioned for a receipt of a food item (16) here, a "Power Bar" therein. Cutout lid (22) may be used to retain the power bar in the cutout (14). Note that the cutout of FIGS. 5A and 5B is cylindrical, whereas the cutout in the embodiment illustrated in FIGS. 6A through 6C is generally rectangular in shape.

Figure 7A:
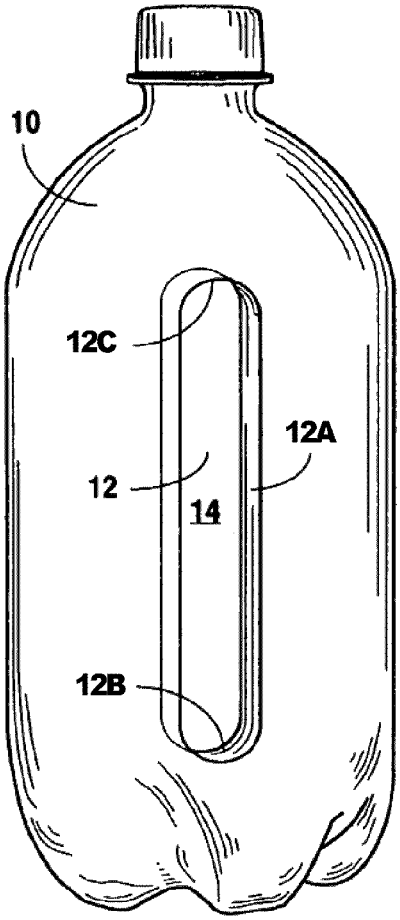
FIGS. 7A and 7B illustrate, in side and front perspective views, another package combination including a container having walls dimensioned to receive an edible food item there within.
Figure 7B:
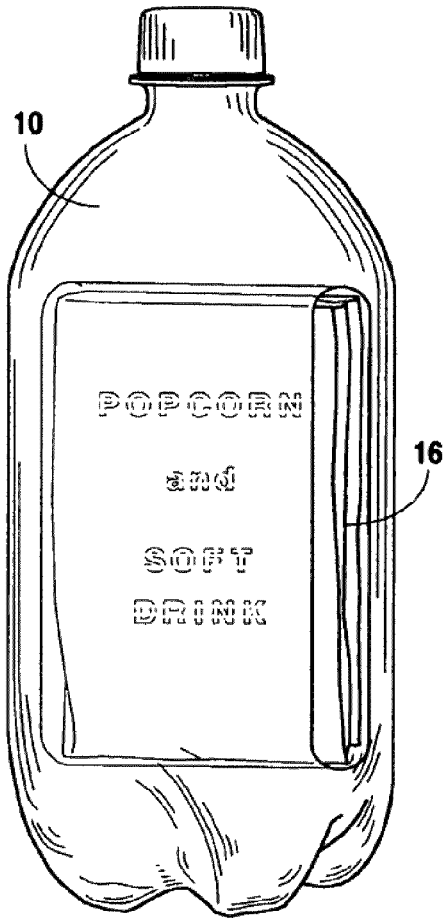

FIGS. 7A and 7B provide yet another alternate preferred embodiment of Applicant's novel package combination (8), including fluid container (10), with walls (12) defining a cutout (14) for containing, at least partially an edible item (16). Note that walls (12) may include a pair of opposed bases (12A/12B). No sidewalls, but a bottom wall (12B) and a top wall (12E). Cutout (14) is in the nature of a slot, running from sidewall to sidewall with the slot dimensioned to receive food item (16) therein. Again, any of the item retainer member (24), glue, label, etc. may be used to retain or otherwise engage food item (16) with fluid container (10).

Figure 8A:
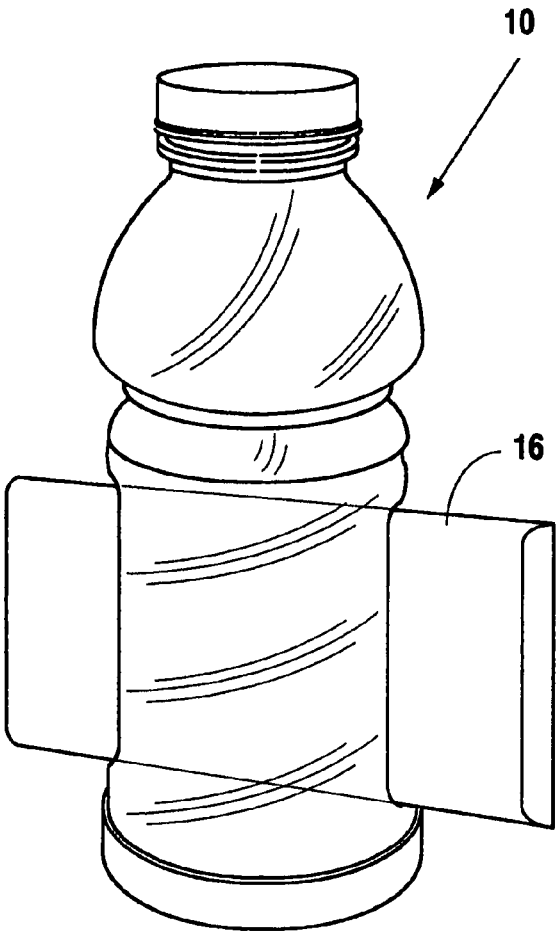
FIGS. 8A and 8B illustrate, in front and side perspective views, yet another variation of Applicant's novel package combination.
Figure 8B:
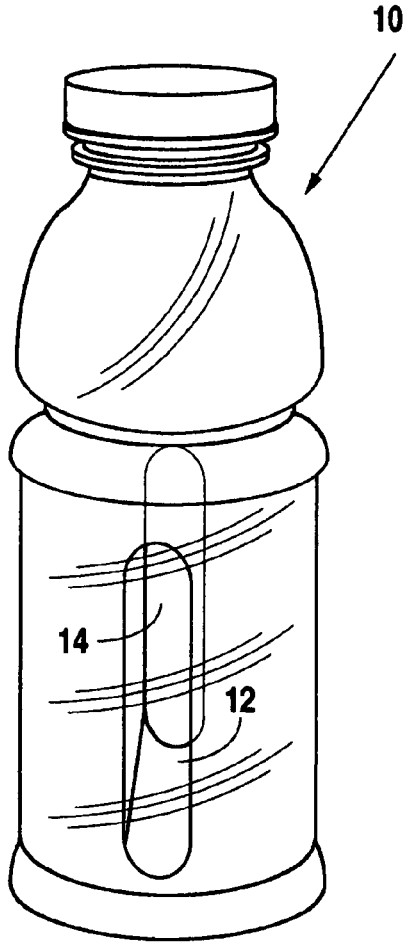

FIGS. 8A and 8B illustrate cutout (14) used with a cylindrical fluid container (10) similar to the embodiment set forth in FIGS. 7A and 7B except that food item (16) extends well beyond open slots in the cylindrical sidewalls of the container.

FIGS. 9A through 9D provide illustrations of a novel fluid container (10) with walls (12) defining a cutout (14) therein for receipt of an edible food item therein. Note that the embodiment illustrated is a cylindrical fluid container (10) with a cutout including bases (12A/12B) spaced apart so as to define a thickness approximate of a food item dimensioned for receipt into the cutout. Moreover, cutout (14) includes a top wall (12E), but no bottom wall. That is, cutout (14) is slotted on three sides, with openings in the cylindrical container sidewall and container bottom wall (30).

FIGS. 10A, 10B and 10C, and FIGS. 11A-11D illustrate an alternate preferred embodiment of Applicant's present invention. Whereas the foregoing embodiments typically provided an opening of cutout (14) to the external walls of container (10), the novel container illustrated in these figures and the novel package combination (10) would typically provide cutout (14) capable of being entirely enclosed within the interior volume of the container. That is, in the embodiment set forth in FIGS. 10A through 10C and 11A through 11D a cutout (14) is provided which cutout includes cutout bases (12A), cutout bottom wall (12B), cutout top wall (12E) and cutout sidewalls (12C/12D) to provide an enclosure, here rectangular, to contain a food item (not shown) or promotional item, such as a T.V. character or toy (not shown) within the interior of a container comprising at least two container portions, here container portion (26) and container portion (28). The embodiments set forth in FIGS. 10A, 10B, 11A-11D will be used to exemplify that mentioned further. Typically, Applicant's package combination includes a fluid container portion made up of at least two portions, which when joined together convey the appearance, at least to the casual glance, of being a single, typical unified container wherein there is a single defined interior for carrying the fluid. However, it is seen that the Applicant has been able to provide a novel combination bearing two container portions (26) and (28), which upon further examination, can be seen to have a number of wall components which engage one another when the two parts are joined together in the manner set forth herein and in the figures accompanying the specifications.

For example, with reference to FIGS. 10A, 10B, 11A-11D, as well as other figures contained herein, it can be seen first part 26 includes the facing wall component (100A) or second part of portion (28) contains facing wall component (100B), wherein when the first and second container parts or portions (26) and (28) are joined together, the facing wall components (100A) and (100B) tend to join in flush relation to one another. Likewise, first part (26) and second part of portion (28) include exterior surface defining components (102A) and (102B), respectively. It can be seen with reference to the accompanying figures that when the two parts of portions (26) and (28) are joined together, the respective exterior surface defining components (102A) and (102B) define an appearance that conveys the outer surface of a regular fluid-bearing "single piece" container.

Turning again to FIGS. 10A, 10B, 11A-11D, it is seen that first part of portion (26) and second part of portion (28) may be seen to have walls defining an inner compartment defining component (104A) and (104B), respectively. Thus, when first part (26) and second part (28) are joined together, inner compartment defining components (104A) and (104B) define an inner compartment (111).

Figure 9B:
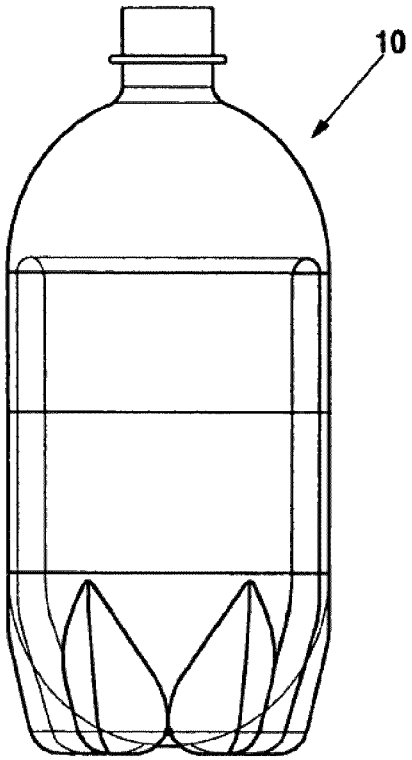
FIGS. 9A through 9D illustrate bottom elevational, front and side elevational and bottom perspective views of yet another variation of Applicant's novel fluid container having walls dimensioned for receipt of an edible item therein.
Figure 9C:
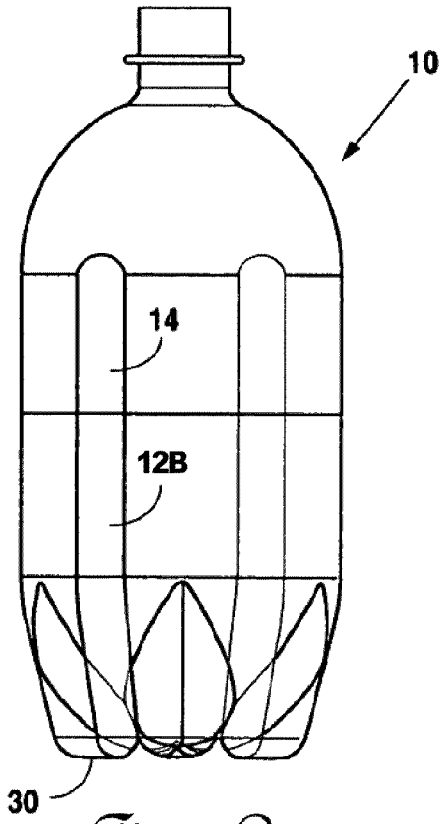
Figure 9A:
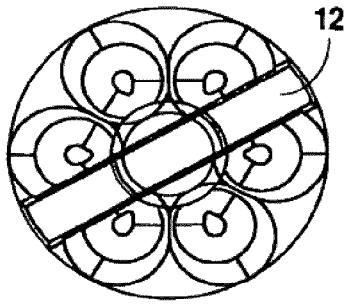
Figure 9D:
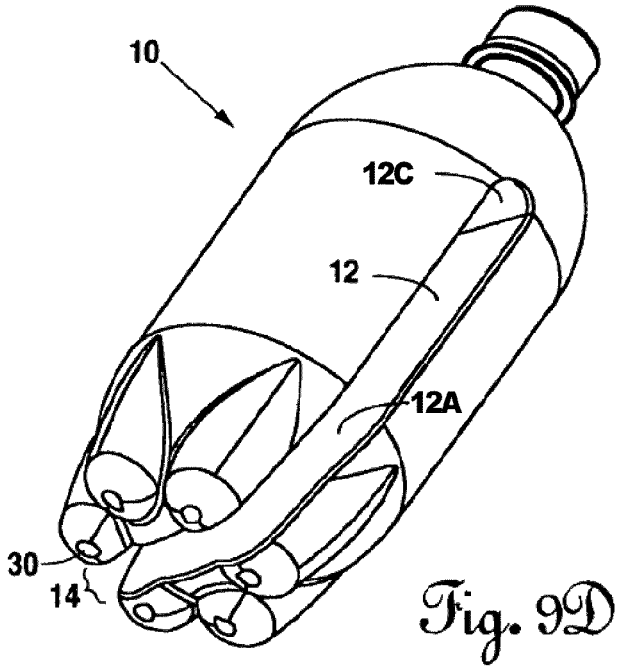
Figure 10B:
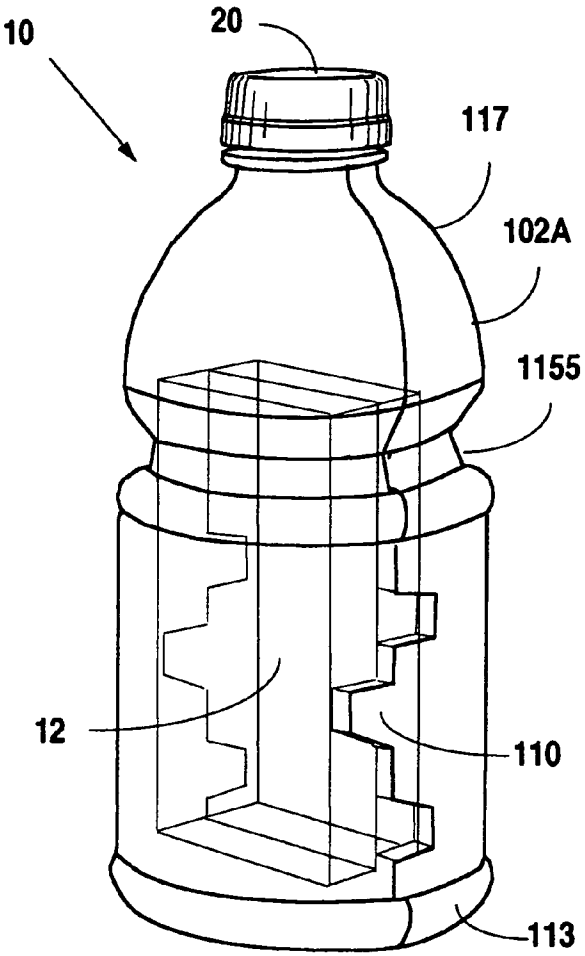
FIGS. 10A and 10B illustrate an exploded perspective view of a novel container for use with Applicant's package combination, FIG. 10A exploded and FIG. 10B showing the parts combined.
Figure 10A:
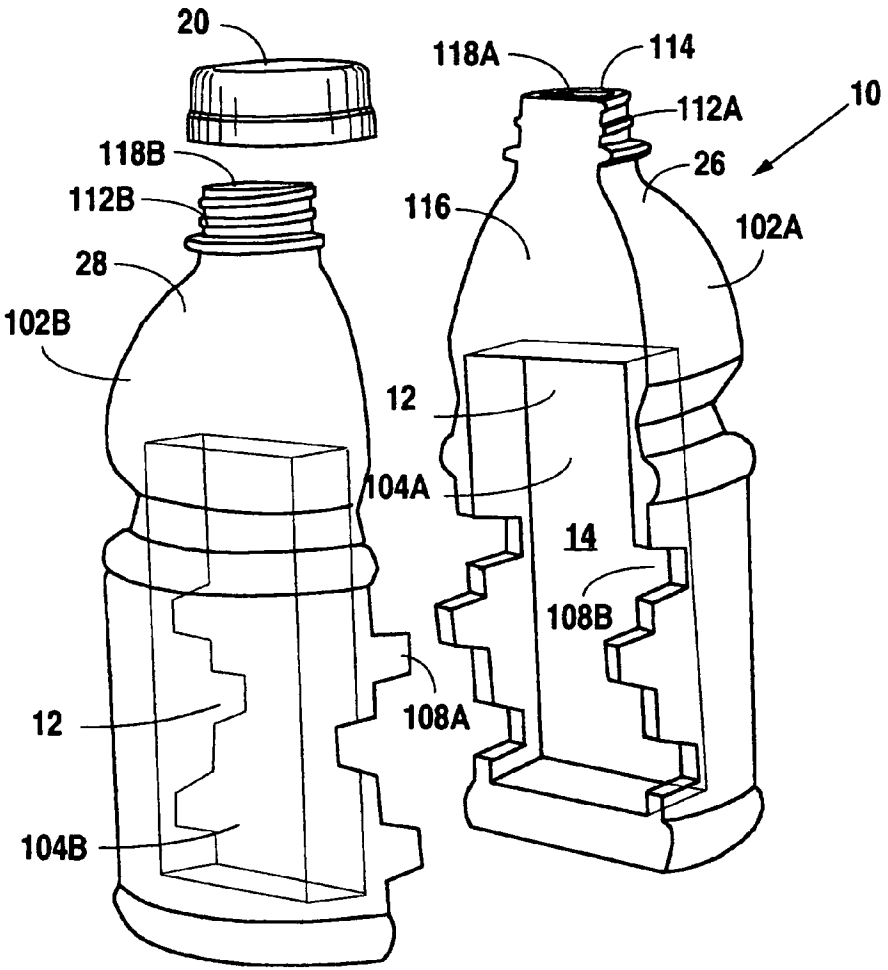
Figure 10C:
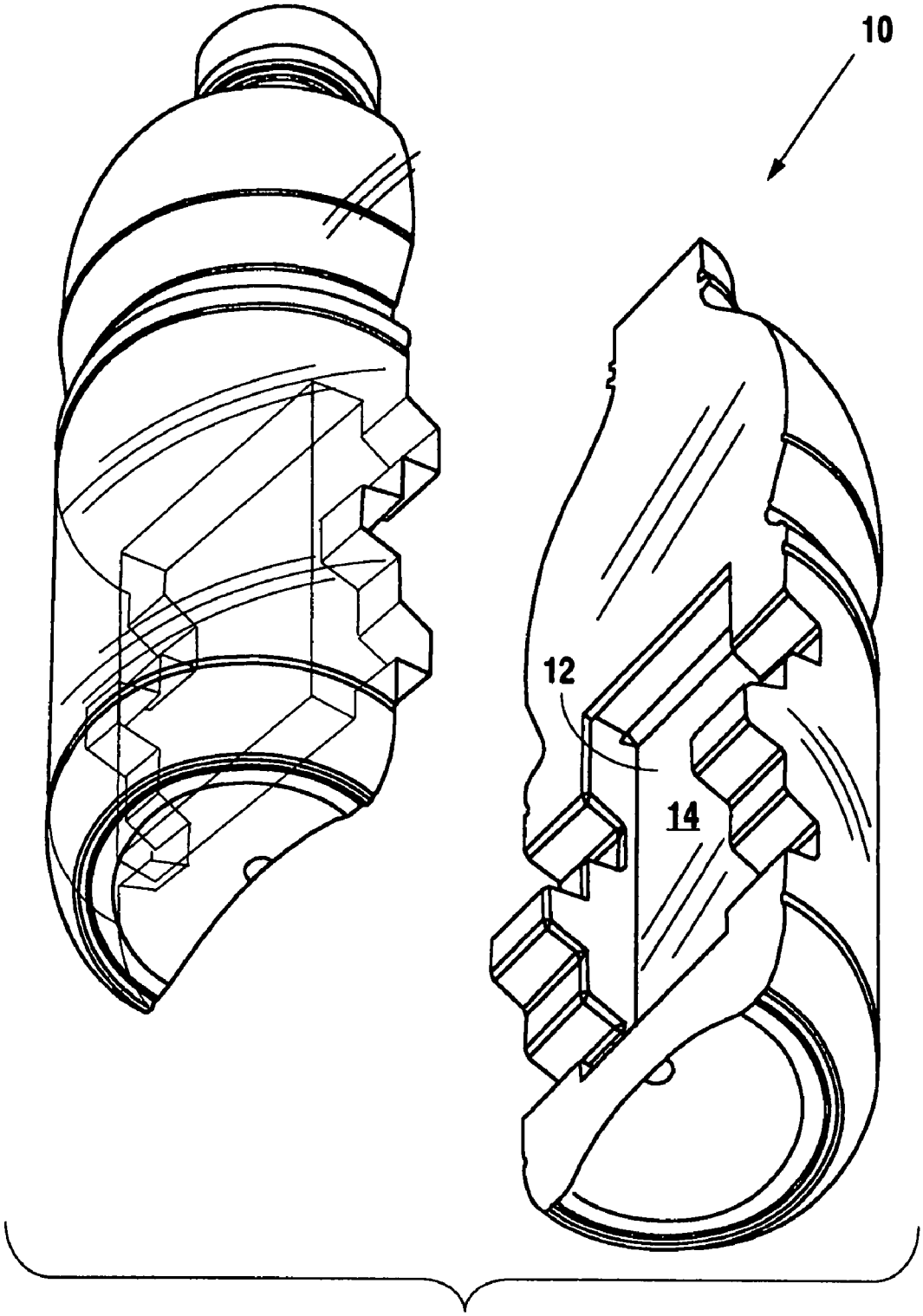
FIG. 10C illustrates yet another exploded view of the novel two-piece container illustrated in FIG. 10A.
Figure 11B:
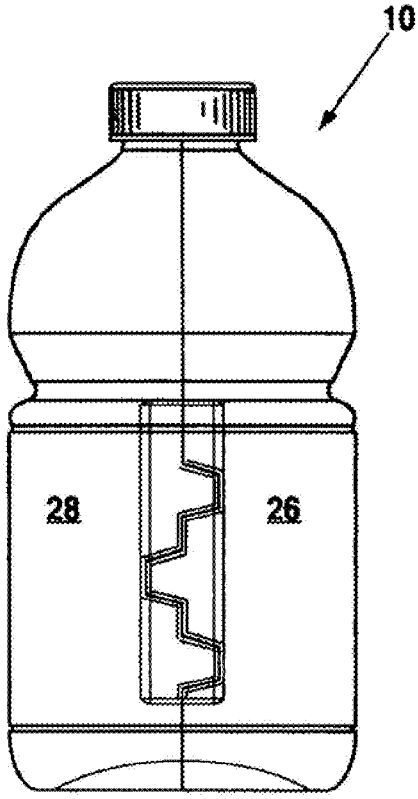
FIGS. 11A through 11D illustrate a bottom elevational, side elevational, front elevational, and an exploded perspective view of a novel two-piece fluid container for use with Applicant's novel package combination, the figures illustrating approximate dimensions in inches. Note that irregular cut-outs are exaggerated for illustrative purposes.
Figure 11C:
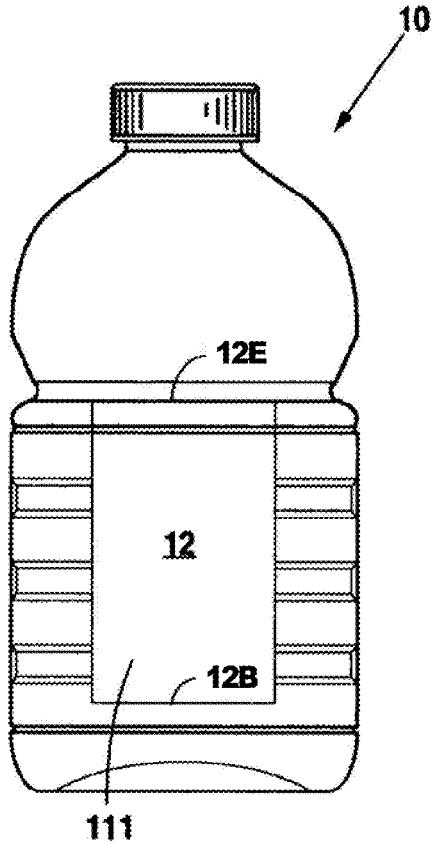
Figure 11A:
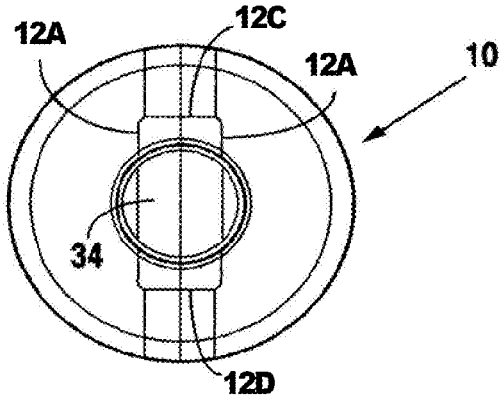
Figure 11D:
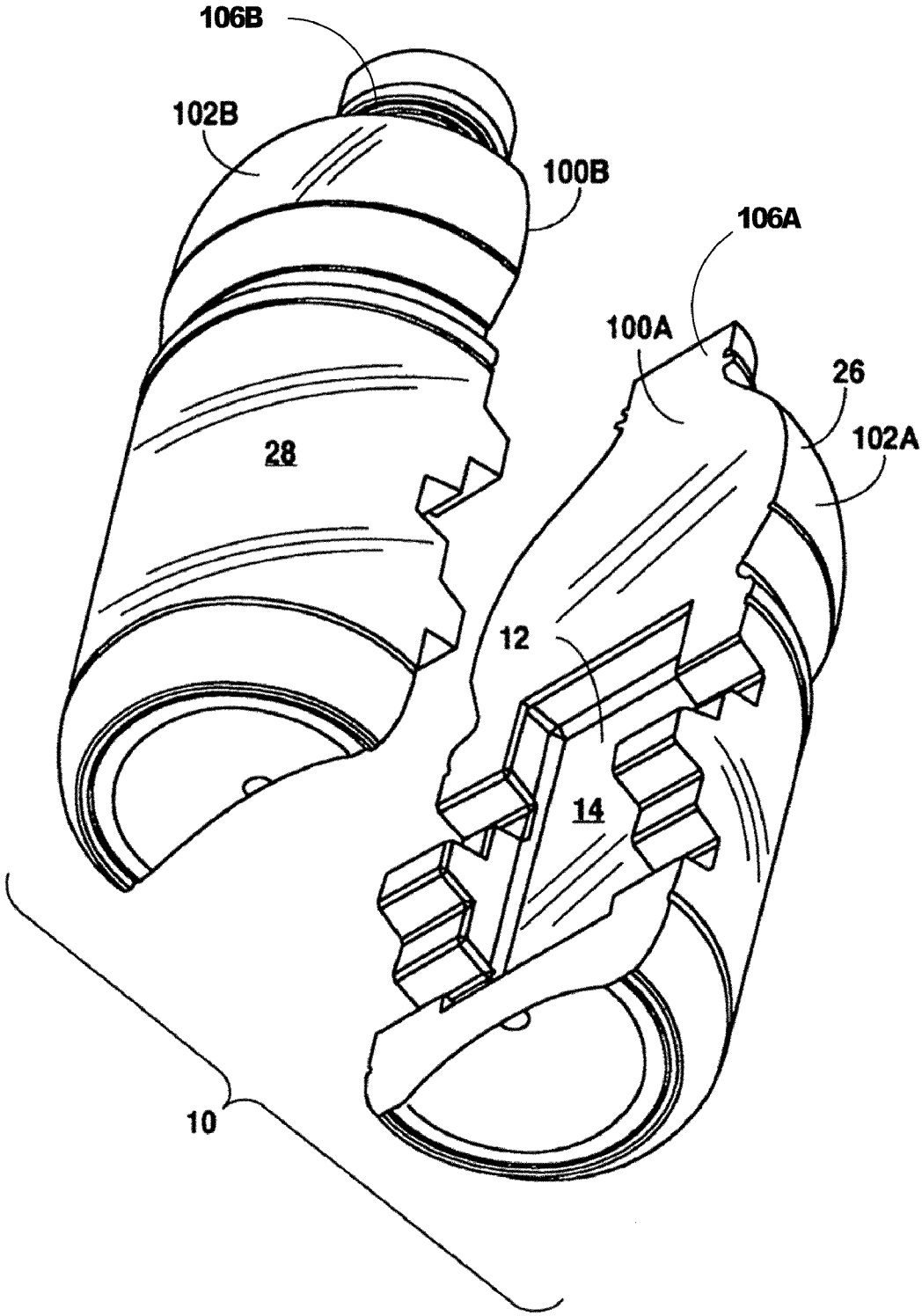

The cavity, heretofore defined as (12), (12A), (12B), (12C), (12D), (12E), may exist in whole or in part and in various geometric forms. For example, with reference to FIGS. 11A-11D, the cavity is rectangular. In reference to FIGS. 5A-5B, the cavity is cylindrical with surface (12B) effectively being replaced with a cap (22) as shown or a small label performing the same function as the cap. In FIGS. 9A-9B, the cavity is represented with walls (12A)-(12C) only. In any cavity geometric variation, the embodiments set forth in FIGS. 10A, 10B, and 11A-11D will be used to exemplify the above.

First part (26) and second part (28) are also seen to include walls including spout defining components (106A) and (106B), respectively, which spout defining components, when first part (26) and second portion (28) are joined together define a single spout that may have a cap engaging portion, such as cap engaging portion (11A) and (11B), respectively, for parts (26A) and (26B), which cap engaging portions (11A) and (11B), for example, threads, are adapted to engage cap or lid (20) in threaded relation or in other ways known in the art.

Facing wall components (100A) and (100B) may be planer and define a single flat plane such that parts or component portions (26) and (28) lay flat against one another, or they may be irregular, as in FIGS. 10A and 10B, 11A-11D, such irregular facing wall components (100A) and (100B), including, for example, projecting portions (108A) for matching engagement with an identically shaped indented portion (108B). When these matching projections and indented portions are provided, there is additional security provided to prevent the two components of parts sliding longitudinally with respect to one another. Thus, locking means (110) may be provided to prevent longitudinal movement of the first part or portion (26) with respect to the second part or portion (28). Irregular cut-outs may also be included to prevent horizontal movement of the first part or portion (26) with respect to the second part of portion (28).

Turning now to more detail of the joined spout engaging portions (112A) and (112B)of fluid container (10), it is seen that spout opening (114) may be provided on either one of the two components or both. That is to say, one of the two components may be adapted to receive, instead of a fluid, something else, such as a multiplicity of small items, for example M&Ms. Thus, spout opening (114) would be a feature of both parts or portions, but one of the two parts or portions may be blocked off so as not to receive any fluid.

Spout opening (114), which may be on one or both of the fluid container parts, may include sealing members (118A) and (118B), as sealing members are known in the art, which sealing members will retain a fluid after removal of cap or lid (20).

A wraparound label, such as plastic or paper film, may be used to wrap around part of the exterior surface defined when the two components or portions are together, to provide information about the contents therein, the labels or other item retainer members (24) would also help to hold the two parts or components together. However, other means of releasably holding the two components or portions (26) and (28) are provided, for example, adhesive layer (116) on some or all of, typically, for example, the facing wall components (100A) and (100B). In some of the embodiments illustrated, a label is provided as a retainer member for an item (see FIGS. 1A and 1B), here, however, the label can achieve the function of releasably securing parts (26A) and (28A) in a joined configuration, as in FIGS. 10B and 11B. So may an adhesive layer, adhesive layers known to have releasable properties, wherein one could pry the two parts apart after the cap is removed therefrom, retain an item therein and then place the two parts back together again.

Either or both parts of fluid container (10) may be blow molded or injection molded. The two parts may be made of clear plastic, which may be transparent or color tinted, in which the clarity of the plastic typically allows the identity of the item inside. The plastic can be made up of monomers, polymers, co-extrusions or laminations using any combination of such to create the structure. The bottle can also be molded in the form of glass. The bottle can also be formed in aluminum.

When a flexible label member is used to help maintain the two parts in flush relation, the flexible label may be plastic which has at least a portion of which is clear and a portion of which has indices therearound, the clear portion allowing a glimpse of the item contained within the interior compartment. The label member may be located between a base (113) and neck (115) of container (10) and/or on a portion of head (117) (see FIG. 10B).

Having pointed out that either the first or second part may contain a liquid, it is further pointed out there that when both parts contain a liquid, the liquid may be the same or the first part may contain a first liquid and the second part a second liquid. Indeed, the liquids may be colored differently for marketing or aesthetic purposes. Further, when there are two different liquids in the respective parts, they may be liquids which can be drank simultaneously when the cap is removed and the container is placed to put a partition between the two spout portions in perpendicular arrangement so that, during the uplifting of the container for fluid to pour into the mouth, portions of the two different liquids enter the mouth at the same time. Those liquids may be and typically would be compatible with one another in taste, for example, one side may contain a regular Cola® and the second part a Cherry Cola®, such when the user drank from both simultaneously, there will be a mixing in the mouth.

Further, Applicant's novel container (10), when used in conjunction with a cap and sealing members (18A) and (18B), a user could drink from one portion, having removed one sealing member, while leaving the other sealing member intact, or remove both sealing members and drink from both simultaneously, at the option of the user.

This might work well, for example, with juices where one side would contain apple juice and the other side, for example, cranberry juice, which may be enjoyed separately or may be combined to form cranberry apple juice by removing both sealing members and drinking from the two open means simultaneously. Further, if the label is used, the label could have indicia on two sides, such that when the label engages the container, one side defines the contents of one part or component and the second side of the label defines the second liquid.

Another example, for illustrative purposes, may include a bottle made of glass with all the embodiments heretofore referred to whereas the fluid may be that of Cutty Sark® Scotch Whiskey with its Tall Ship trademark encased three dimensionally in the cavity described "A Ship in a Bottle" . . . the easy way.

Figure 12A:
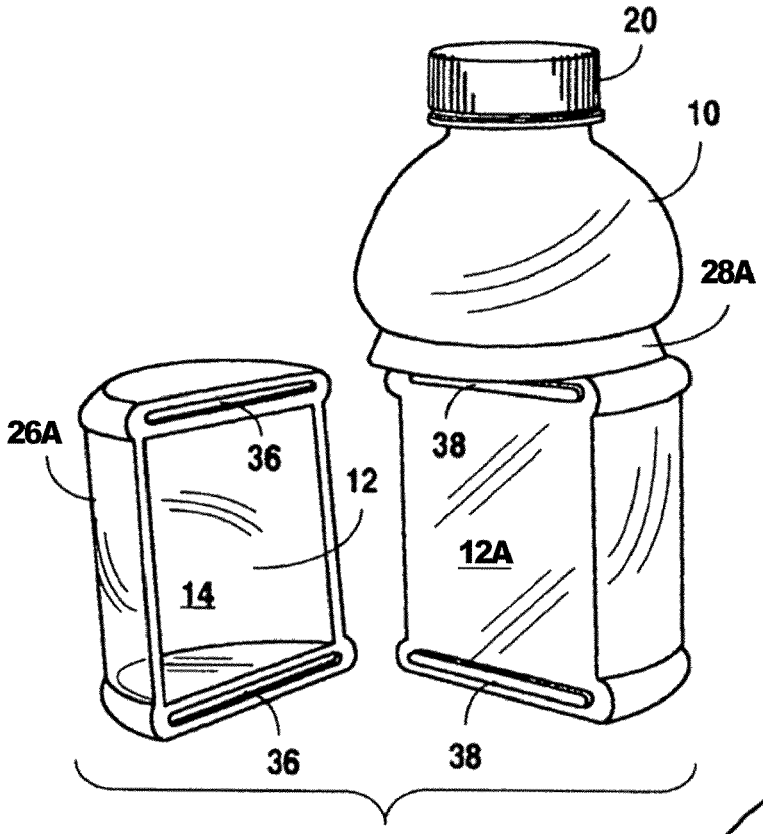
FIGS. 12A and 12B illustrate yet another alternate preferred embodiment of Applicant's present invention wherein the container is two separate parts, one part for containing a fluid therein and the second part containing some but not all of the walls comprising cutout (14), the two parts releaseably engaged one to the other so as to provide, when the two parts are joined together, a smooth walled regular configuration (such as the cylindrical sidewalls of containers featured in FIGS. 12A and 12B), but capable of containing, an interior volume therof, a food item that may be viewed from without the container.
Figure 12B:
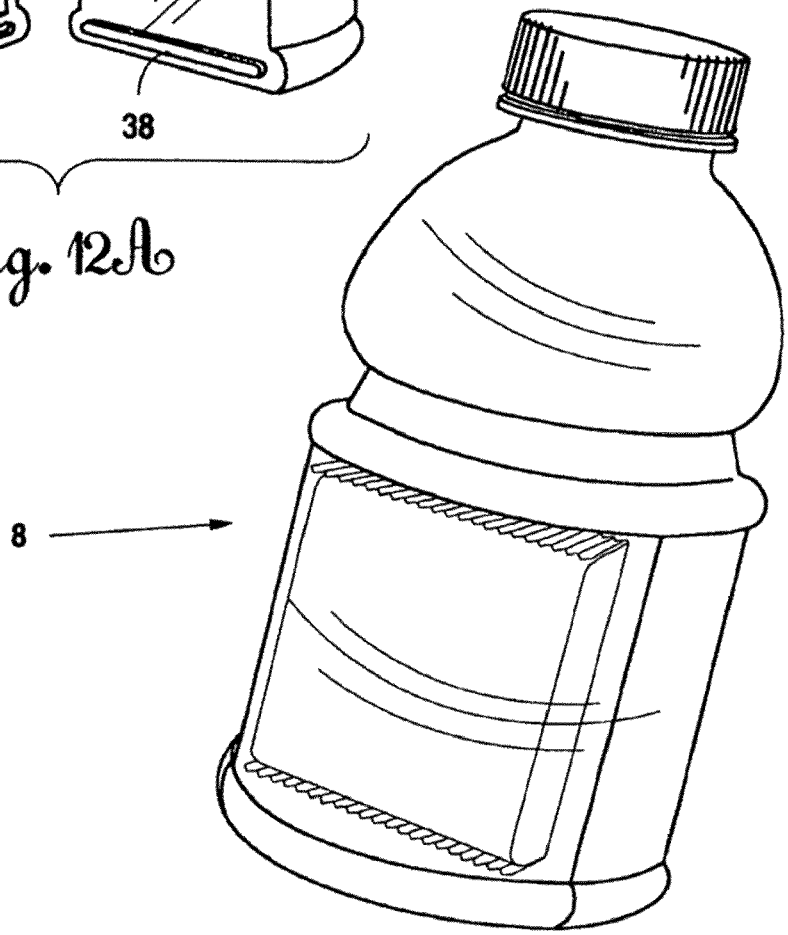

FIGS. 12A and 12B illustrate yet another alternate preferred embodiment of Applicant's present invention. As in FIGS. 10 and 11 above, this embodiment anticipates a fully enclosed cutout (14). Unlike FIGS. 10 and 11, however, the two container portions, here designated (26A and 28A) differ. Container portion (28A) is adapted to be capable of receiving and maintaining a fluid, such as juice, water, soda, etc., therein. Portion (26A) is not intended to receive any fluid and is provided only to define an enclosed cutout (14) wholly within the interior of the outside walls of container (10). A boss or projection (36) may be provided in portion (26A), along with a groove or receiving channel (38) in portion (28A) to provide for a prop or snap fit between the two portions, so as to secure an edible item (16) there within.

Figure 13A:
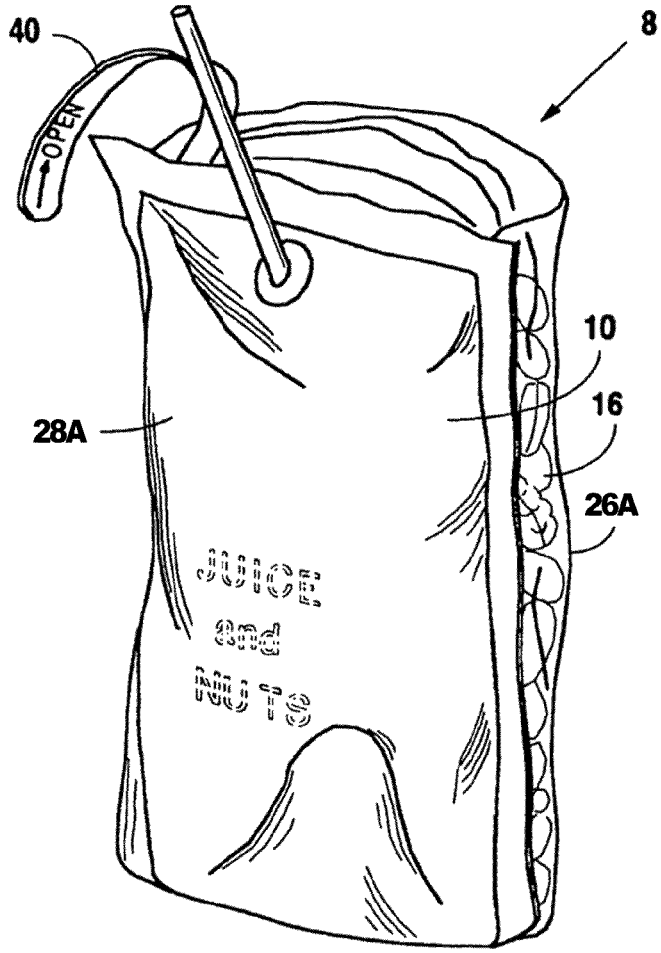
FIGS. 13A and 13B illustrate yet another alternate preferred embodiment of Applicant's present invention of combining in a container both a fluid and a cutout (14) for placement of edible item (16) therein. Here, flexible walled containers such as those for juice includes a portion thereof, again with flexible typically clear walls, for containing a multiplicity of edible items therein—here nuts.
Figure 13B:
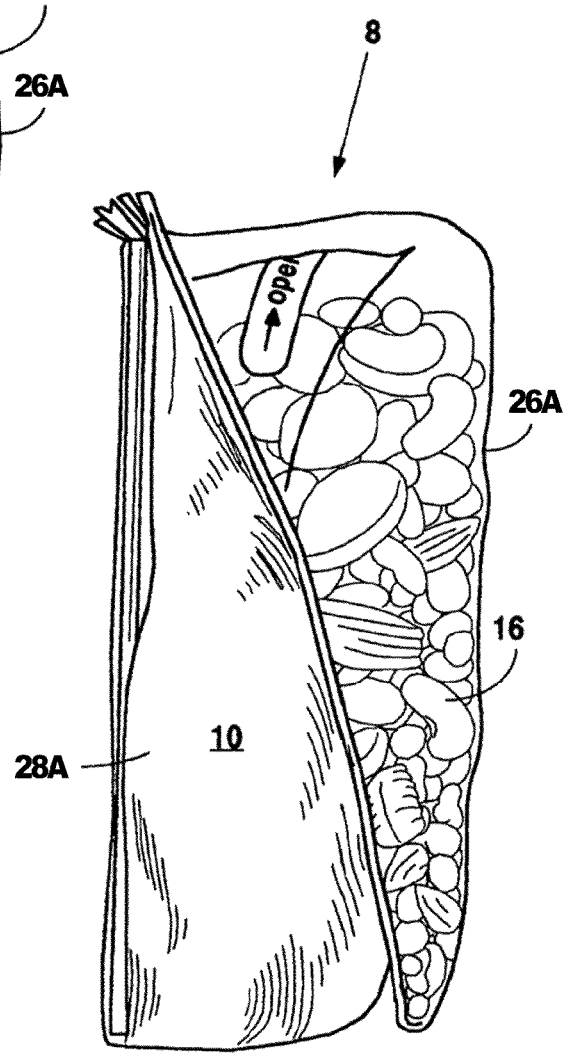

FIGS. 13A and 13B illustrate yet another alternate preferred embodiment of Applicant's packaged combination (8). What is illustrated is a flexible wall container (10), here a familiar juice pack container. Portion (28A) of container (10) is designed to include the liquid portion of the combination and portion (26A) is designed solely to join portion (28A) and, contained therein, typically, as is set forth with the embodiments above, in some kind of a clear or see-through cover or walls, ingredients or item (16). Here the specific combination shown is "juice and nuts." A tear-off strip (40) may be provided between portions (26A/28A), such tear-off strips known in the art, to provide access to edible item (16) therein.

There are various versions of even this enclosed cutout (14) version of Applicant's novel package combination (8). For example, cutout (14) may be wholly within either of container portions (26) or (28) or part of cutout (14) may be in one container portion and part in the other. Container portions (26/28) may engage one another, after a suitable dimensioned edible item (16) is placed within cutout (14), by means such as glue, the label, or any other method or member. Indeed, each of container portions (26/28) is self-contained to hold a fluid therein and the same or different fluids may be provided in each of the two container portions which would then have a split drinking opening (34).

Any or all of the exterior of the container may contain printed material as by silk screen or other methods known in the trade.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. The package combination comprising:

a fluid container having an exterior surface and a substantially closed interior compartment, the fluid container comprising:

a first part having walls defining an interior volume capable of containing a fluid therein and the walls including a facing wall component, an inner compartment defining component, an exterior surface defining component, and a spout defining component;

a second part having walls, including a facing wall component, an inner compartment defining component, an exterior surface defining component, and a spout defining component, wherein the facing wall component of the first and second parts are adapted to substantially engage one another in generally flush relation when the two parts are joined together, wherein the interior compartment defining components of the first and second parts are dimensioned to form the interior compartment when the two parts are joined together, wherein the exterior surface defining components of the first and second parts are adapted to form the exterior surface when the two parts are joined and wherein the spout defining components of the first and second parts are adapted to define a spout with a cap engaging portion when the two parts are joined;

a member capable of engaging the two parts to releasably maintain the two parts together with the walls in general flush relation, the member comprising a label;

a cap dimensioned for receipt onto the cap engaging portion;

wherein the two parts are made of transparent plastic;

wherein the first part contains a first liquid and the second part contains a second liquid, the liquids having different colors; and wherein the label has indicia on two areas, such that when the label engages a container, one area of the label defines the content of the one part and another area of the label defines the content of the second part.

2. The package combination of claim 1, wherein the first part contains a first juice and the second part contains a second juice.

3. The package combination of claim 1, wherein the two liquids include a cola and a flavored cola.

4. The package combination of claim 1, wherein one of the liquids is water.

* * * * *